US011248422B2

(12) United States Patent
Bergeron et al.

(10) Patent No.: US 11,248,422 B2
(45) Date of Patent: Feb. 15, 2022

(54) SYSTEM FOR GUIDING A TUBULAR DURING SUBTERRANEAN DRILLING OPERATIONS

(71) Applicant: NABORS DRILLING TECHNOLOGIES USA, INC., Houston, TX (US)

(72) Inventors: Jamie Bergeron, Youngsville, LA (US); Hendrik Schalk Le Roux, Lafayette, LA (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 226 days.

(21) Appl. No.: 16/566,669

(22) Filed: Sep. 10, 2019

(65) Prior Publication Data

US 2020/0095832 A1 Mar. 26, 2020

Related U.S. Application Data

(60) Provisional application No. 62/736,862, filed on Sep. 26, 2018.

(51) Int. Cl.

| | |
|---|---|
| ***E21B 17/02*** | (2006.01) |
| ***E21B 17/10*** | (2006.01) |
| ***E21B 23/12*** | (2006.01) |
| *E21B 19/22* | (2006.01) |

(52) U.S. Cl.

CPC ..... *E21B 17/026* (2013.01); *E21B 17/1078* (2013.01); *E21B 23/12* (2020.05); *E21B 19/22* (2013.01)

(58) Field of Classification Search

CPC ..... E21B 19/00–24; E21B 17/026

See application file for complete search history.

(56) References Cited

U.S. PATENT DOCUMENTS

| | | | | |
|---|---|---|---|---|
| 6,491,107 | B2 | 12/2002 | Dearing et al. | |
| 7,201,233 | B2 | 4/2007 | Penisson et al. | |
| 7,967,073 | B2 | 6/2011 | Boutwell, Jr. et al. | |
| 9,637,984 | B2 | 5/2017 | Webre et al. | |
| 9,938,780 | B2 | 4/2018 | Begnaud | |
| 2005/0161227 | A1 | 7/2005 | Hayes et al. | |
| 2006/0231268 | A1 | 10/2006 | Wood | |
| 2008/0053661 | A1* | 3/2008 | Funk | E21B 19/24 166/380 |
| 2008/0264650 | A1 | 10/2008 | Begnaud et al. | |
| 2016/0356102 | A1 | 12/2016 | Meeks | |

* cited by examiner

*Primary Examiner* — Kristyn A Hall

(74) *Attorney, Agent, or Firm* — Abel Schillinger, LLP; Enrique Abarca

(57) ABSTRACT

A method of conducting subterranean drilling operations comprising guiding a tubular with a first guide arranged in a first configuration; coupling an umbilical line to the tubular with an engagement element; guiding the tubular with a second guide; arranging the first guide to a second configuration to permit longitudinal passage of the engagement element past the first guide; and arranging the first guide to the first configuration after the engagement element is past the first guide. A system for conducting subterranean operations comprising a first guide and a second guide disposed at different vertical elevations, wherein the first and second guides are adapted to provide continuous support to a tubular in a lateral direction when the tubular is coupled with an umbilical line.

20 Claims, 9 Drawing Sheets

SYSTEM FOR GUIDING A TUBULAR DURING SUBTERRANEAN DRILLING OPERATIONS

CROSS-REFERENCE TO RELATED APPLICATION(S)

This application claims priority under 35 U.S.C. § 119(e) to U.S. Patent Application No. 62/736,862, entitled "Systems and Methods of Conducting Subterranean Drilling Operations," by Jamie Bergeron and Hendrik Schalk Le Roux, filed Sep. 26, 2018, of which is assigned to the current assignee hereof and incorporated herein by reference in its entirety.

FIELD OF THE DISCLOSURE

The present disclosure relates to systems and methods of conducting subterranean drilling operations, and more specifically to systems and methods adapted to continuously guide a tubular into a wellbore.

RELATED ART

Subterranean drilling operations typically utilize a tubular string advanced into a wellbore. In certain instances, drilling operations are conducted offshore with floating drill rigs. It is not uncommon for drill strings to operate in hundreds or thousands of feet of water in offshore drilling operations. At such depths, ocean currents can affect drilling operations, sometimes causing misalignment and poor torque transfer. The effect of water current can be even more pronounced during operations utilizing an umbilical line coupled with the drill string. Excessive misalignment and poor torque transfer can result in premature wear and damage to the drill string, drill rig, or both.

The drilling industry continues to demand improvements in systems and methods of conducting subterranean drilling operations.

BRIEF DESCRIPTION OF THE DRAWINGS

These and other features, aspects, and advantages of present embodiments will become better understood when the following detailed description is read with reference to the accompanying drawings in which like characters represent like parts throughout the drawings, wherein.

DETAILED DESCRIPTION

Figure 1:
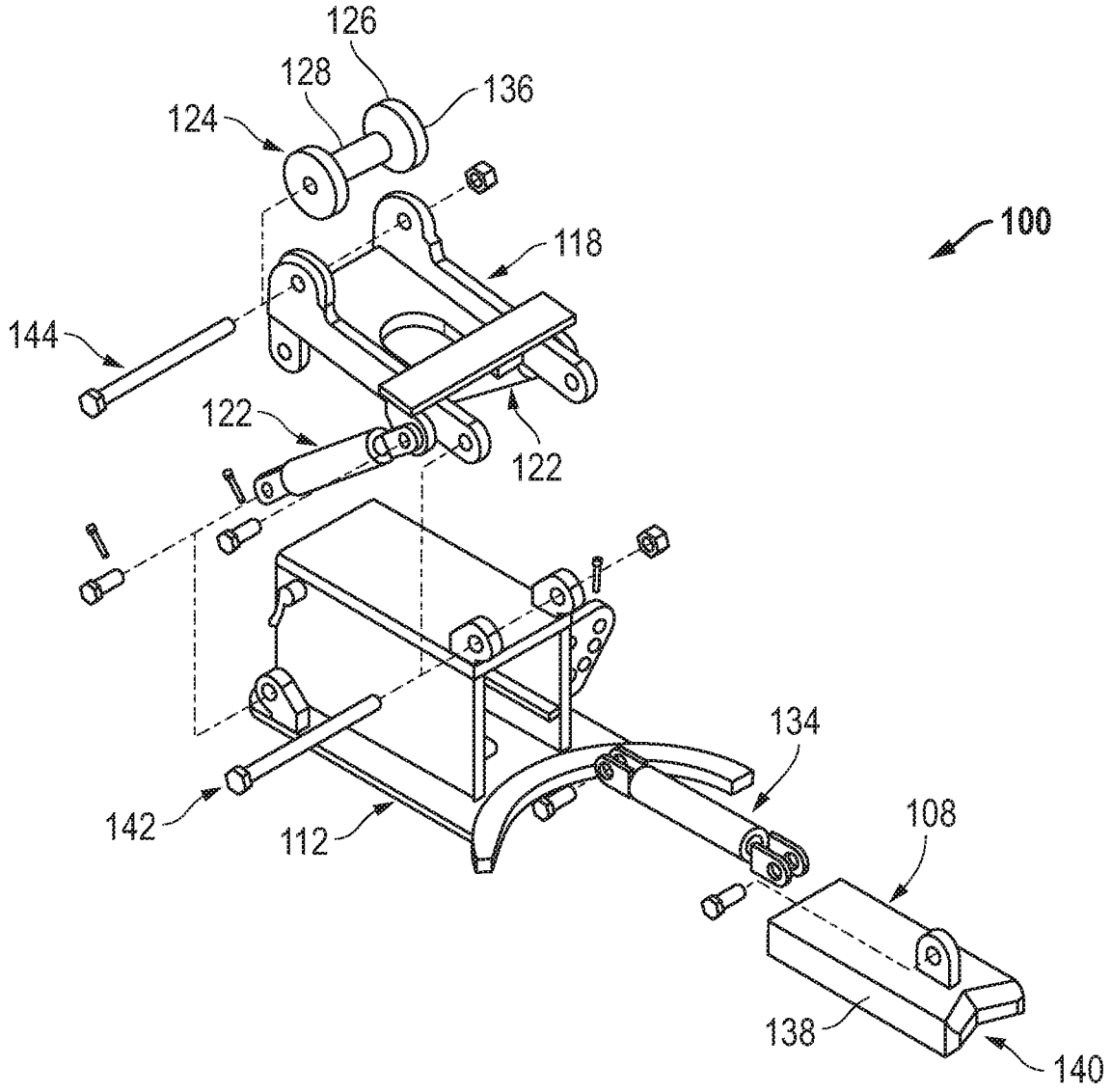
FIG. 1 includes a partially exploded perspective view of a portion of a system for guiding a tubular in a subterranean operation, in accordance with an embodiment.

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. However, other embodiments can be used based on the teachings as disclosed in this application.

The terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive- or and not to an exclusive- or. For example, a condition A or B is satisfied by any one of the following: A is true (or present) and B is false (or not present), A is false (or not present) and B is true (or present), and both A and B are true (or present).

The terms "generally," "substantially," "approximately," and the like are intended to cover a range of deviations from the given value. In a particular embodiment, the terms "generally," "substantially," "approximately," and the like refer to deviations in either direction of the value within 10% of the value, within 9% of the value, within 8% of the value, within 7% of the value, within 6% of the value, within 5% of the value, within 4% of the value, within 3% of the value, within 2% of the value, or within 1% of the value.

Also, the use of "a" or "an" is employed to describe elements and components described herein. This is done merely for convenience and to give a general sense of the scope of the invention. This description should be read to include one, at least one, or the singular as also including the plural, or vice versa, unless it is clear that it is meant otherwise. For example, when a single item is described herein, more than one item may be used in place of a single item. Similarly, where more than one item is described herein, a single item may be substituted for that more than one item.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in textbooks and other sources within the oil and gas drilling arts.

In accordance with a particular aspect, a method of conducting subterranean drilling operations can generally include guiding a tubular with a first guide arranged in a first configuration, coupling an umbilical line to the tubular with an engagement element, guiding the tubular with the second guide, arranging the first guide to a second configuration to permit longitudinal passage of the engagement element pas the first guide, and arranging the first guide to the first configuration after the engagement element is past the first guide. In a particular embodiment, the first and second guides are spaced apart from one another. In a more particular embodiment, the first and second guides are disposed at different vertical elevations as compared to one another. For instance, the first guide can be disposed at a first vertical elevation and the second guide can be disposed at a second vertical elevation above the first elevation.

In an embodiment, the first guide can include a first support and a second support. The first and second supports can be spaced apart from one another, such as on opposite sides of the tubular. In an embodiment, the first and second supports of the first guide are disposed on a same horizontal plane. In another embodiment, the second guide can include a first support and a second support. The first and second supports of the second guide can be spaced apart from one another, such as on opposite sides of the tubular. In an embodiment, the first and second supports of the second guide can be disposed on a same horizontal plane as compared to one another. In an embodiment, the first support of the first guide and the first support of the second guide can be disposed along a same vertical plane as one another. In another embodiment, the second support of the first guide and the second support of the second guide can be disposed along a same vertical plane as one another. In yet a further embodiment, the first and second supports can all lie along a same vertical plane as one another.

In another particular aspect, a system for conducting subterranean operations can include a first guide and a second guide disposed at different vertical elevations. The first and second guide can be adapted to provide continuous support to the tubular in a lateral direction when the tubular is coupled with an umbilical line.

In a further aspect, a system for conducting subterranean operations can include a first guide adapted to guide a tubular and a second guide adapted to guide the tubular. In an embodiment, the first guide can be translatable between a first configuration adapted to guide the tubular and a second configuration where the first guide is spaced apart from the tubular. In another embodiment, the second guide can be rotatable between a first configuration adapted to guide the tubular and a second configuration where the second guide is spaced apart from the tubular.

Figure 2:
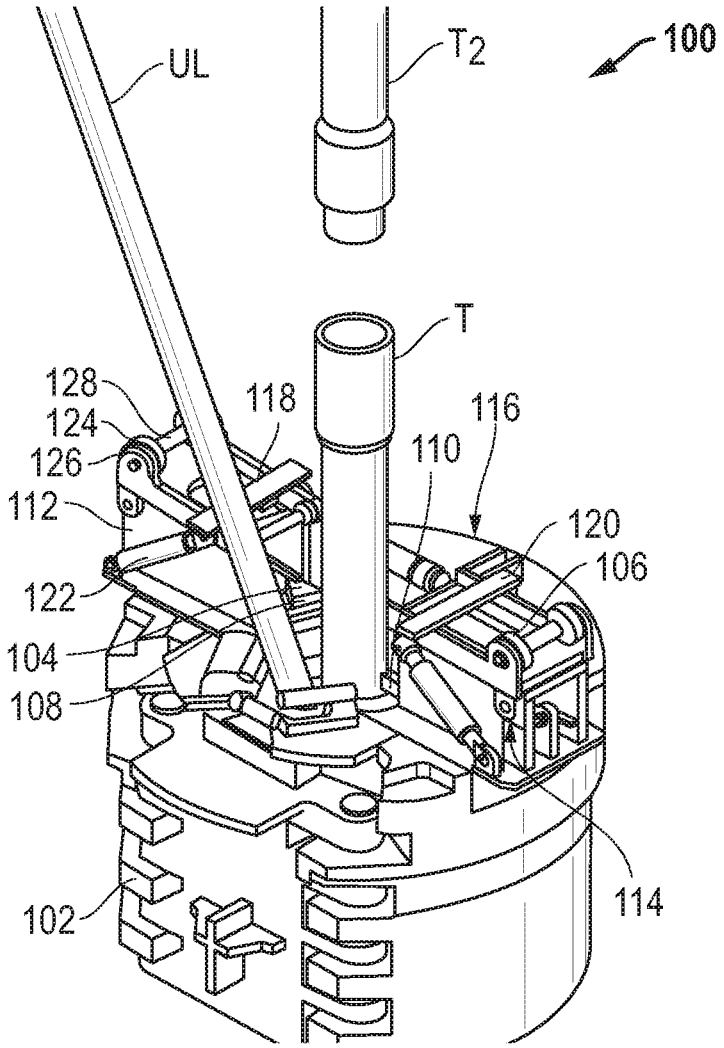
FIGS. 2 to 10 include systems in accordance with embodiments described herein as seen during various phases of subterranean drilling operations.

Referring to FIGS. 1 and 2, a system 100 for conducting subterranean operations can generally include a slip 102 having a first guide 104 and a second guide 106. The slip 102 can be disposed on a drill rig (not illustrated) around a work area, such as around an area corresponding with a lateral position above a wellbore. In a particular embodiment, the slip 102 can be disposed on, or within, a drill rig floor (not illustrated). While not limited to offshore drill rigs, in a particular instance, the system 100 can be utilized with offshore drill rigs, particularly in locations where underwater currents are strong.

As described in greater detail below, the first and second guides 104 and 106 can include a lower set of guides 104 and an upper set of guides 106, as illustrated in FIG. 2. The first and second guides 104 and 106 can be disposed in a single housing or split between a plurality of housings, such as a first housing 112 and a second housing 114. In a particular embodiment, a first support 108 of the first guide 104 and a first support 118 of the second guide 106 can be coupled with a same housing 112 as one another. For example, the first supports 108 and 118 can be disposed on a first lateral side of the slip 102 corresponding with the housing 112. The second support 110 of the first guide 104 and the second support 120 of the second guide 106 can be coupled with another same housing 114. For example, the second supports 110 and 120 can be disposed on a second lateral side of the slip 102 corresponding with the housing 114. The housings 112 and 114 can be disposed on the slip 102—for example, at generally opposite locations around a tubular (or tubular string) T. In an embodiment, the first and second housings 112 and 114 and the components coupled therewith can be the same, or generally the same, as one another. In another embodiment, the first and second housings 112 and 114 or the components coupled therewith can be different from one another.

In an embodiment, the first guide 104 can include a plurality of supports, such as a first support 108 and a second support 110. In an embodiment, the first and second supports 108 and 110 can be adapted to be disposed on opposite sides of the tubular T. In a more particular embodiment, the first and second supports 108 and 110 can be disposed on diametrically opposite sides of the tubular T.

In an embodiment, the first and second supports 108 and 110 can have the same shapes, sizes, or a combination thereof. In another embodiment, the first and second supports 108 and 110 can have different shapes, different sizes, or a combination thereof.

In an embodiment, the first support 108 comprises a body adapted to translate in a generally lateral direction. For instance, in a particular embodiment, the first support 108 can be adapted to translate perpendicular to an axis of the tubular T.

The first and second supports 108 and 110 of the first guide 104 can be reconfigurable between at least a first configuration (FIG. 3) and a second configuration (FIG. 2). In the first configuration, at least one of the first and second supports 108 and 110 can contact the tubular T. In a more particular embodiment, both of the first and second supports 108 and 110 can contact the tubular T when the first guide 104 is in the first configuration. In the second configuration, the first and second supports 108 and 110 can be spaced apart from the tubular T. As described below in greater detail, the first and second supports 108 and 110 can be spaced apart from the tubular T by a distance sufficient to permit passage of an engagement element 130 (FIG. 4) there between.

In an embodiment, the first guide 104 can be selectively reconfigurable between the first and second configurations by translation of at least one of the first and second supports 108 and 110. In a more particular embodiment, the first guide 104 can transition between the first and second configurations by translation of both the first and second supports 108 and 110. In an embodiment, at least one of the first and second supports 108 and 110 can translate along a plane perpendicular to an axis of the tubular T. In another embodiment, at least one of the first and second supports 108 and 110 of the first guide 104 can translate along a generally horizontal plane.

In an embodiment, at least one of the first and second supports 108 and 110 can translate at least 1 inch, as measured between the first and second configurations, at least 2 inches, at least 3 inches, at least 4 inches, or at least 5 inches. In a more particular embodiment, both the first and second supports 108 and 110 can translate at least 1 inch, as measured between the first and second configurations, at least 2 inches, at least 3 inches, at least 4 inches, or at least 5 inches.

In an embodiment, the first support 108 can include a body 138 defining an inner contact surface 140 adapted to contact the tubular T. In certain instances, the inner contact surface 140 of the first support 108 can include a concave surface adapted to receive the tubular T. In a particular embodiment, the inner contact surface 140 can include linear surfaces joined together at a relative angle between 0° and 180°. In another particular embodiment, the inner contact surface 140 of the first support 108 can be arcuate or otherwise curvilinear. In an embodiment, the first and second supports 108 and 110 can both include bodies 138 defining inner contact surfaces adapted 140 to contact the tubular T.

In an embodiment, the first and second supports 108 and 110 can be disposed at least partially within housings 112 and 114, respectively. The housings 112 and 114 can be coupled with the slip 102, such as for example, along an upper surface 116 of the slip 102. In certain instances, at least one of the housings 112 and 114 can define side walls, a top wall, a bottom wall, or any combination thereof. In an embodiment, at least one of the supports 108 and 110 can be coupled with an actuator 134 adapted to bias the at least one of the supports 108 and 110 toward and away from the tubular T. In a particular embodiment, the actuator 134 can be coupled between the at least one of the supports 108 and 110 and the respective housing 112 and 114. By way of non-limiting example, the actuator 134 can include a manual actuator, a pneumatic actuator, a hydraulic actuator, an electrical actuator, a spring-based actuator, a chain actuator, another actuating element, or any combination thereof. In certain instances, the first and second supports 108 and 110 of the first guide 104 can be biased by a same type of actuator 134. In a more particular embodiment, the first and second supports 108 and 110 of the first guide 104, or the actuators thereof, can be in communication with one another. In a more particular embodiment, the first and second supports 108 and 110 of the first guide 104, or the actuators thereof, can be coupled or synchronized together to generate a same lateral support force against the tubular T.

In an embodiment, the second guide 106 can include a plurality of supports, such as a first support 118 and a second support 120. In an embodiment, the first and second supports 118 and 120 can be disposed on opposite halves of the tubular T. In a more particular embodiment, the first and second supports 118 and 120 can be disposed on diametrically opposite sides of the tubular T.

In the illustrated embodiment, the second guide 106 is disposed at a different vertical elevation as compared to the first guide 104. In a more particular embodiment, the second guide 106 can be disposed above the first guide 104. In an embodiment, the first and second supports 118 and 120 of the second guide 106 can be disposed at a different vertical elevation as compared to the first and second supports 108 and 110 of the first guide 104. In a more particular embodiment, the first and second supports 118 and 120 of the second guide 106 can be disposed above the first and second supports 108 and 110 of the first guide 104.

The first and second guides 104 and 106 can be spaced apart from one another. In an embodiment, the first and second guides 104 and 106 do not contact one another. In another embodiment, the first and second guides 104 and 106 are coupled together through the housings 112 and 114.

In an embodiment, the second guide 106 can be selectively reconfigurable between at least a first configuration (FIG. 8, described in greater detail below) and a second configuration (FIG. 2). In the first configuration, at least one of the first and second supports 118 and 120 can contact the tubular T. In a more particular embodiment, both the first and second supports 118 and 120 can contact the tubular T when the second guide 106 is in the first configuration. In the second configuration, the first and second supports 118 and 120 can be spaced apart from the tubular T. In such a manner, the second guide 106 can be out of the way of the tubular T when arranged in the second configuration.

In an embodiment, the second guide 106 can transition between the first and second configurations by rotation of at least one of the first and second supports 118 and 120. In a particular embodiment, the second guide 106 can transition between the first and second configurations by rotation of both the first and second supports 118 and 120. In an embodiment, at least one of the first and second supports 118 and 120 can rotate along a plane parallel with the axis of the tubular T. In another embodiment, at least one of the first and second supports 108 and 110 of the second guide 106 can rotate along a generally vertical plane.

In an embodiment, at least one of the first and second supports 118 and 120 of the second guide 106 is adapted to rotate at least 5°, at least 10°, at least 15°, at least 20°, at least 30°, at least 45°, at least 60°, or at least 75°. In another embodiment, at least one of the first and second supports 118 and 120 of the second guide 106 is adapted to rotate no greater than 180°, or no greater than 90°.

Referring again to FIG. 1, in an embodiment, the first support 118 of the second guide 106 can be coupled to the housing 112 at a pivot axis. By way of example, the pivot axis can be defined by a pin 142 coupled between the housing 112 and the first support 118. In a particular embodiment the pivot axis is perpendicular with the axis of the tubular T. In a more particular embodiment, the pivot axis is disposed on a generally horizontal plane.

In an embodiment, the first support 118 of the second guide 106 can be pivotally coupled with the housing 114. In a more particular embodiment, the first support 118 of the second guide 106 can be pivotally coupled to the housing 114 at or adjacent to an end of the first support 118 closest to the tubular T. In such a manner, the first support 118 can pivot from a generally horizontal orientation (FIG. 2) to a generally vertical orientation (FIG. 8).

In certain instances, the first support 118 can be coupled with the housing 112 through an actuator 122. In a more particular instance, the first support 118 can be coupled with the housing 114 through a plurality of actuators 122. For example, the first support 118 can be coupled with the housing 112 through at least two actuators 122, at least three actuators 122, at least four actuators 122, or at least five actuators 122. By way of non-limiting example, the actuator(s) 122 can include a manual actuator, a pneumatic actuator, a hydraulic actuator, an electrical actuator, a spring-based actuator, a chain actuator, another actuating element, or any combination thereof. In multi-actuated assemblies, the actuators can be in communication with one another, such as coupled together or synched, to generate a same pivot force of the first support 118 against the tubular T.

Figure 8:
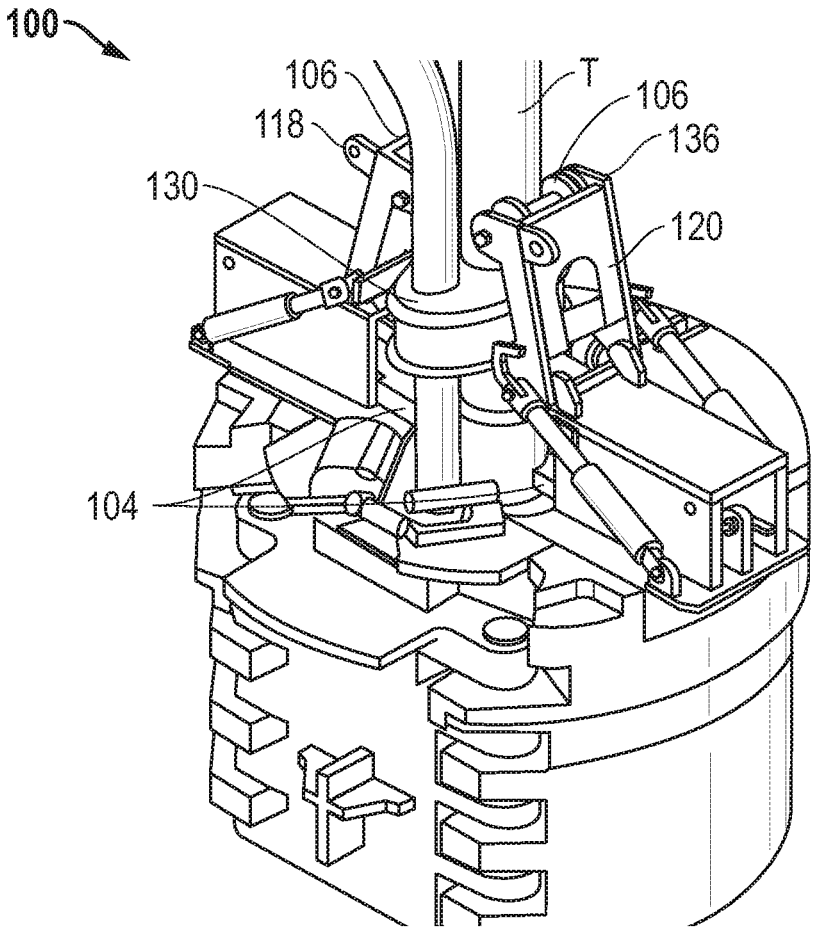

In an embodiment, the first support 118 can further include an interface 124 adapted to contact the tubular T when the second guide 106 is in the first configuration (FIG. 8). The interface 124 can include, for example, a rotatable member, an arcuate member, or a combination thereof. In the illustrated embodiment, the interface 124 can include a roller 136 having at least one end portion 126 and a middle portion 128. In a particular instance, the interface 124 can cradle the tubular T when the second guide 106 is in the first configuration. That is, for example, the tubular T can contact the middle portion 128 or contact the roller between the end portions 126. In an embodiment, the roller 136 can be coupled with the first support 118 of the second guide 106 by way of an axle 144.

FIG. 2 illustrates an exemplary initial alignment between a tubular (or tubular string) T already engaged with the slip 102 and an additional tubular $T_2$ being added to the tubular T. It is noted that while the first guide 104 is illustrated in the second configuration, in certain instances the first guide 104 can be disposed in the first configuration during alignment or subsequent engagement of the additional tubular $T_2$ with the tubular T.

An umbilical line UL can extend through the slip 102. The umbilical line UL can be a cable, hose or pipe which is run along the length of the tubular T. In the offshore drilling industry, it is frequently necessary to run umbilical lines hundreds and even thousands of feet below the drill rig down to the sea floor and beyond. Typically, umbilical lines (sometimes referred to as control lines) are hydraulic, electric, or fiber optic in nature. Umbilical lines can include multiple separate lines bundled together in any combination into a single line.

In the illustrated embodiment, the umbilical line UL is disposed between the first and second housings 112 and 114. In a more particular embodiment, the umbilical line UL can be equally, or generally equally, spaced apart from the first and second housings 112 and 114. In certain instances, the first and second supports 108, 110, 118, and 120 of the first and second guides 104 and 106 are disposed along, or generally along, a same plane. The umbilical line UL can be spaced apart from the plane. After an initial coupling operation, the umbilical line UL can be coupled with the tubular T at an elevation above the slip 102 (as described in greater detail below).

In certain instances, the tubular T can be supported by the slip 102 or an elevator during engagement with the additional tubular $T_2$. The additional tubular $T_2$ can be lowered toward the tubular T and threaded into engagement therewith. The elevator can be released, permitting axial translation of the tubular T relative to the slip 102.

Figure 3:
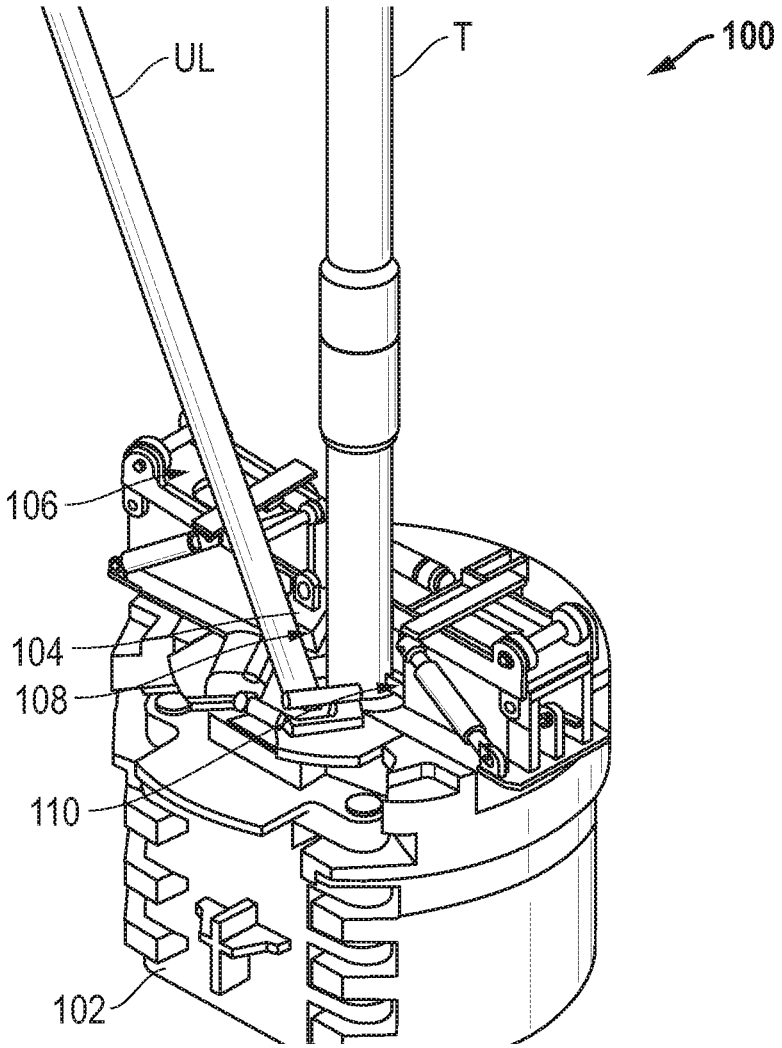

FIG. 3 illustrates the system 100 after engaging the additional tubular $T_2$ (FIG. 2) with the tubular T. The first guide 104 is illustrated in the first configuration, guiding the tubular T into the wellbore (not illustrated) below the drill rig. The second guide 106 is disposed in the second configuration, spaced apart from the tubular T. The umbilical line UL can remain spaced apart from the tubular T during engagement with additional tubular $T_2$. More specifically, the umbilical line UL as seen above the slip 102 can remain spaced apart from the tubular T during engagement with the additional tubular $T_2$. In such a manner, the umbilical line UL can remain safe from damage which might occur as a result of the engagement process of the additional tubular $T_2$ with the tubular T.

In an embodiment, the first and second supports 108 and 110 of the first guide 104 can be spaced apart by a distance, DS, as measured in the first configuration, that is no less than a diameter, DT, of the tubular T. For instance, DS can be at least 1.0 DT, at least 1.01 DT, at least 1.05 DT, at least 1.1 DT, at least 1.2 DT, or at least 1.25 DT. In certain embodiments, at least one of the first and second supports 108 and 110 can remain spaced apart from the tubular T when the first guide 104 is in the first configuration. In other embodiments, at least one of the first and second supports 108 and 110 can contact the tubular T when the first guide 104 is in the first configuration. In a more particular embodiment, the first and second supports 108 and 110 of the first guide 104 can contact the tubular T when the first guide 104 is in the first configuration.

In an embodiment, the first guide 104 can define a tubular receiving area having a first diameter, $D_1$, in the first configuration and a second diameter, $D_2$, in the second configuration, where $D_2$ can be at least 1.01 $D_1$, at least 1.05 $D_1$, at least 1.1 $D_1$, at least 1.25 $D_1$, at least 1.5 $D_1$, or at least 1.75 $D_1$. In an embodiment, $D_2$ can be no greater than 10.0 $D_1$, no greater than 5.0 $D_1$, or no greater than 2.0 $D_1$.

In an embodiment, at least one of the first and second supports 108 and 110 can be adapted to bias the tubular T when the first guide 104 is in the first configuration. That is, for example, at least one of the first and second supports 108 and 110 can contact and press against the tubular T with a force sufficient to support the tubular T. For example, in a particular embodiment, the first and second supports 109 and 110 can contact and press against the tubular T with a force of at least 1 N, at least 10 N, at least 100 N, at least 250 N, at least 500 N, or at least 1000 N. In another embodiment, the at least one of the first and second supports 108 and 110 can contact the tubular T with a force of no greater than 20,000 N, no greater than 10,000 N, no greater than 7,500 N, or no greater than 5,000 N. In certain instances, at least one of the first and second supports 108 and 110 of the first guide 104 can include a roller or other low friction interface (not illustrated) adapted to prevent stiction or frictional buildup between the at least one of the first and second supports 108 and 110 and the tubular T.

Figure 4:
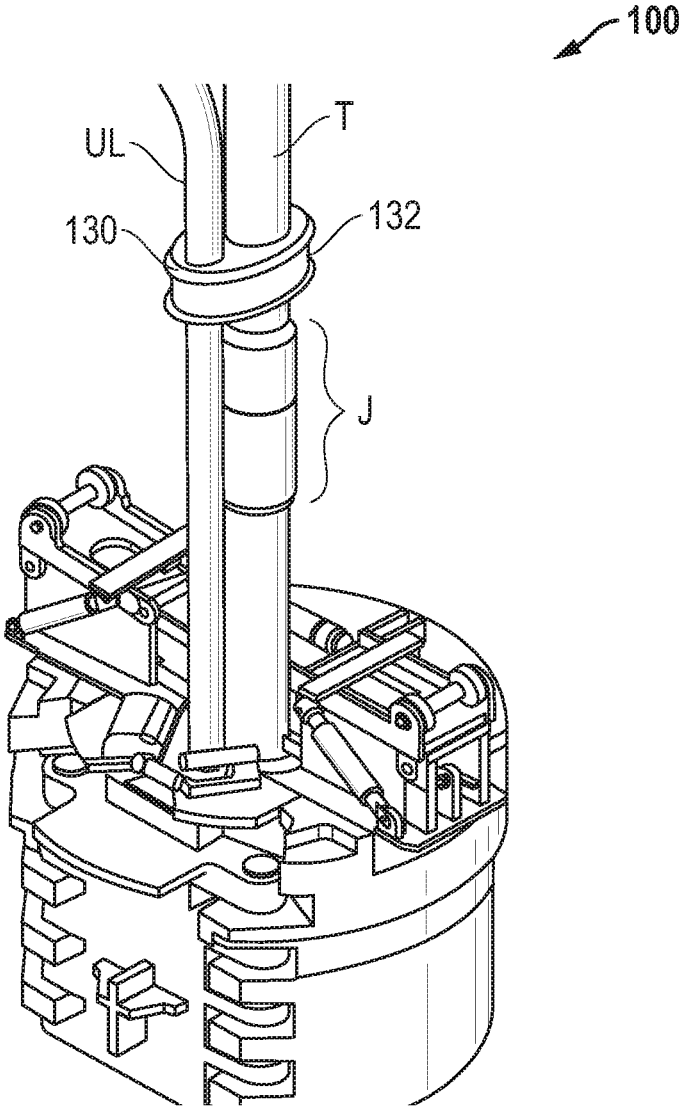

FIG. 4 illustrates an embodiment of the system 100 after an engagement element 130 is coupled with the umbilical line UL, the tubular T, or a combination thereof. In a particular embodiment, the engagement element 130 can include a clamp adapted to extend around at least a portion of the tubular T and at least a portion of the umbilical line UL, securing the umbilical line UL to the tubular T. In an embodiment, the engagement element 130 can include a relatively soft material, such as for example, a material having a Shore A durometer hardness no greater than 90.

Installation of the engagement element 130 with the tubular T can be performed by installing the engagement element relative to the tubular T and securing the engagement element 130 relative to the tubular T with a wrap 132. The wrap 132 can extend around the engagement element 130 and securely couple the umbilical line UL with the tubular T.

In the illustrated embodiment, the engagement element 130 is coupled with the tubular T at a location above a joint J between successive tubulars. In a particular embodiment, the engagement element 130 is coupled with the tubular T at a location spaced apart from the joint J, or a nearest portion of the joint J, by at least 2 inches, at least 3 inches, at least 4 inches, at least 5 inches, or at least 6 inches. In another embodiment, the engagement element 130 is coupled with the tubular T at a location spaced apart from the joint by no greater than 60 inches, no greater than 40 inches, no greater than 20 inches, no greater than 15 inches, or no greater than 10 inches. In a particular embodiment, a nearest portion of the engagement element 130 is spaced apart from a nearest portion of the joint J by a distance in a range of 1 inch and 60 inches, in a range of 2 inches and 50 inches, in a range of 3 inches and 30 inches, in a range of 4 inches, and 20 inches, or in a range of 5 inches and 10 inches.

Figure 5:
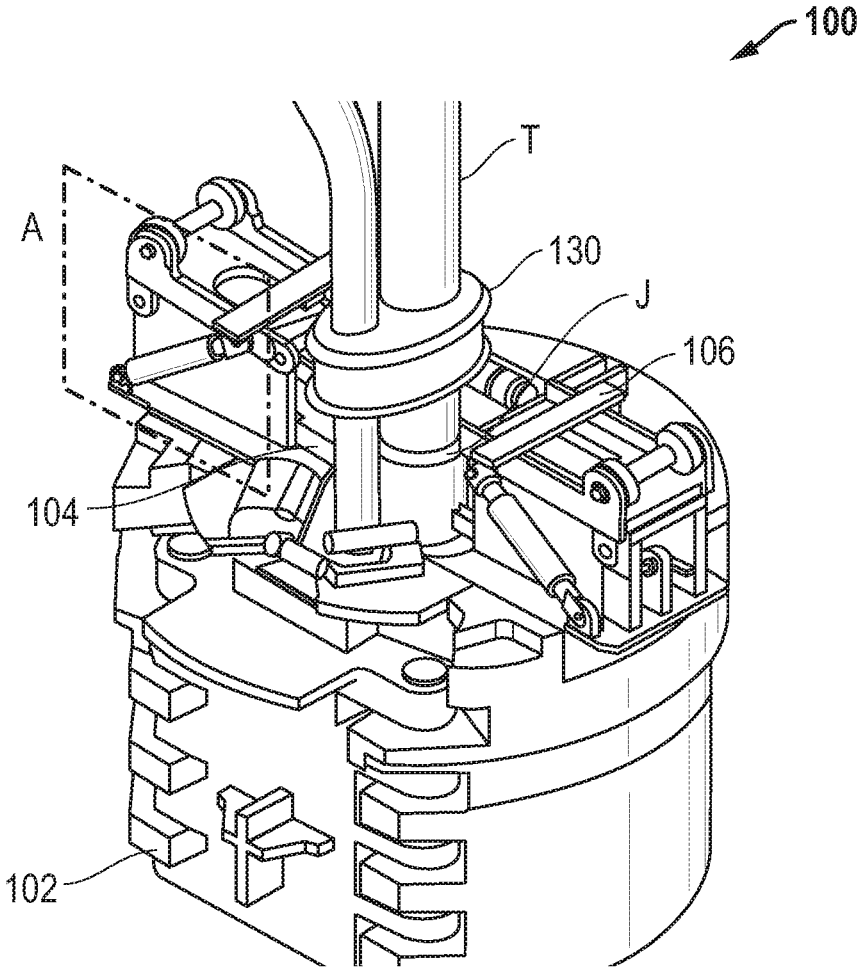

Referring to FIG. 5, the tubular T can then be lowered through the slip 102 until the top of the engagement element 130 is within an area defined between the first guide 104 and a the second guide 106 when the second guide 106 is disposed in the first configuration. In an embodiment, the first and second guides 104 and 106 are vertically spaced apart by at least a thickness, $T_{EE}$, of the engagement element 130, as measured parallel with a length of the tubular T. In another embodiment, the first and second guides 104 and 106 are spaced apart by at least $T_{EE}$+0.1 $T_{EE}$, at least $T_{EE}$+0.5 $T_{EE}$, or at least $T_{EE}$+1.0 $T_{EE}$. In another embodiment, the first and second guides 104 and 106 are spaced apart by no greater than $T_{EE}$+20.0 $T_{EE}$ or no greater than $T_{EE}$+10.0 $T_{EE}$. In a more particular embodiment, the first and second guides 104 and 106 are spaced apart by no greater than $T_{EE}$+5.0 $T_{EE}$. In an embodiment, the area between the first and second guides 104 and 106 can have a height in a range of 1 inch and 60 inches, in a range of 2 inches and 50 inches, in a range of 5 inches and 40 inches, in a range of 10 inches and 30 inches, or in a range of 20 inches and 25 inches.

It is noted that the first guide 104 may be reconfigured from the first configuration to permit passage of the joint J of the tubular T. For instance, the first guide 104 can be opened slightly when the joint J passes through the first guide 104 to accommodate the wider tubular diameter. In an embodiment, the first guide 104 is reconfigured all the way to the second configuration to permit passage of the joint J of the tubular T. In another embodiment, the first guide 104 is only partially reconfigured to the second configuration to permit passage of the joint J of the tubular.

Figure 6:
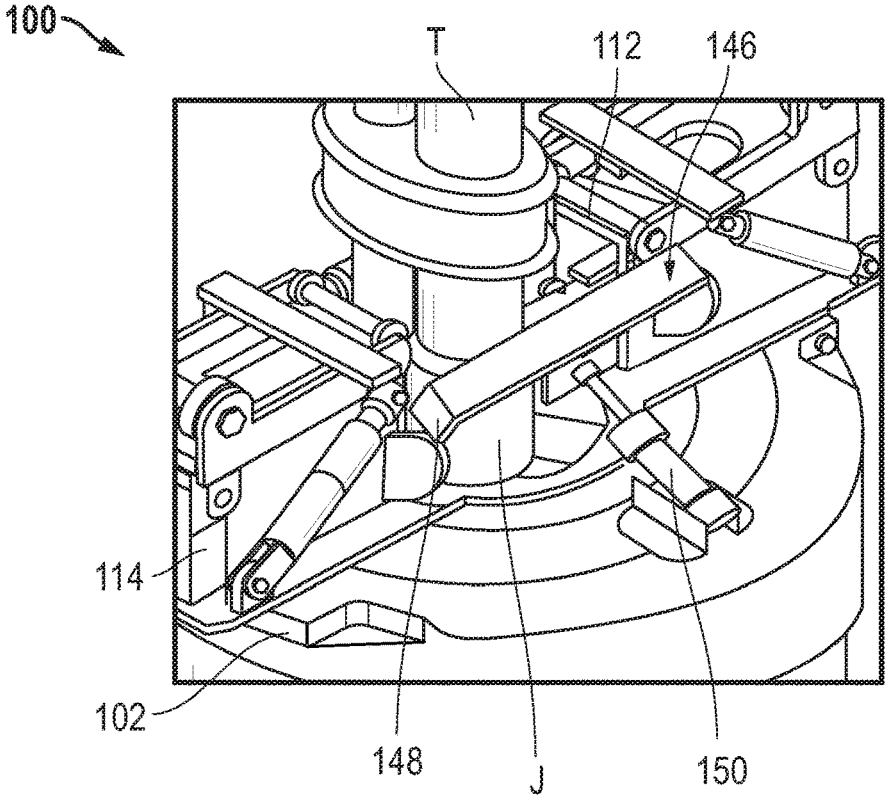

As illustrated in FIG. 6, in an embodiment, the system 100 can further include a stabilizer 146 separate from the first and second guides 104 and 106. In a particular embodiment, the stabilizer 146 can include a body 148 coupled to the slip 102 or one or both of the housings 112 and 114. The stabilizer 146 can be biased by an actuator 150 toward and away from the tubular T. In certain instances, the stabilizer 146 can be utilized to assist in centralizing the tubular T, particularly when the first guide 104 is slightly opened to accommodate passage of the joint J.

Figure 7:
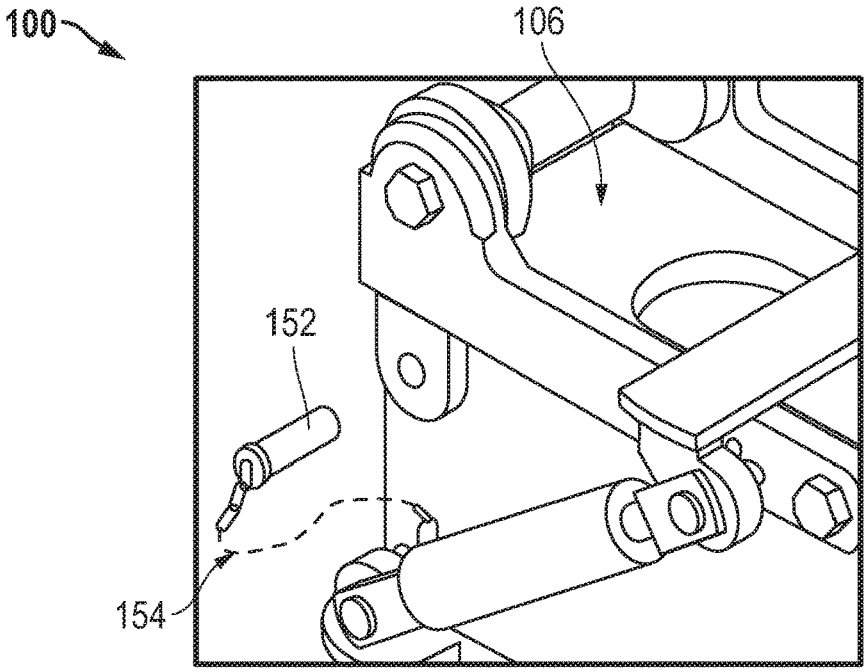

FIG. 7 illustrates a perspective view as seen in Box A in FIG. 5. In an embodiment, the system 100 can include a safety device 152 adapted to prevent accidental movement of the second guide 106 between the first and second configurations. In an embodiment, the safety device 152 can include a pin, such as a locking pin, selectively engageable with the second guide 106, the housing 112, or a combination thereof. In an embodiment, the safety device 152 can be retained by a tether 154.

Prior to reconfiguring the second guide 106 from the second configuration to the first configuration, the safety device 152 can be deactivated. For example, the locking pin 152 can be pulled to permit rotation of the first support 118 toward to the tubular T.

FIG. 8 illustrates the system 100 with the second guide 106 engaged with the tubular T above the engagement element 130. As illustrated, the roller 136 of the first and second supports 118 and 120 can contact an outer surface of the tubular T and guide the tubular T to prevent it from moving from the center of the slip 102. Meanwhile, the first guide 104 is maintained proximate to the tubular T during reconfiguration of the second guide 106 to the first configuration.

Figure 9:
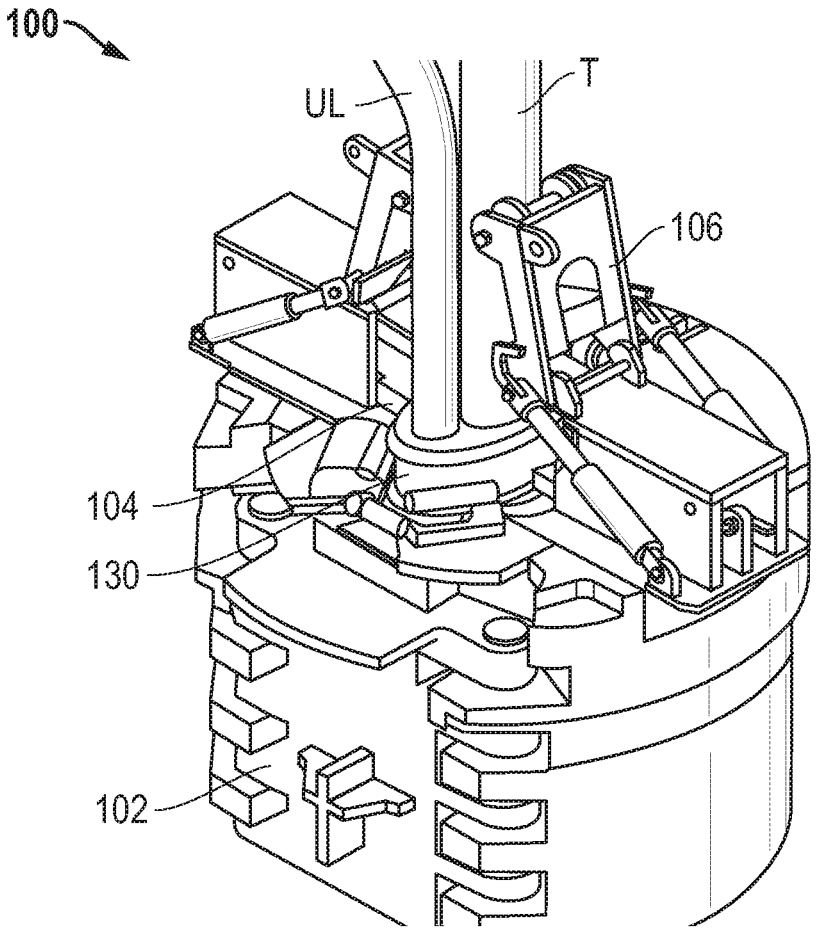
Figure 10:
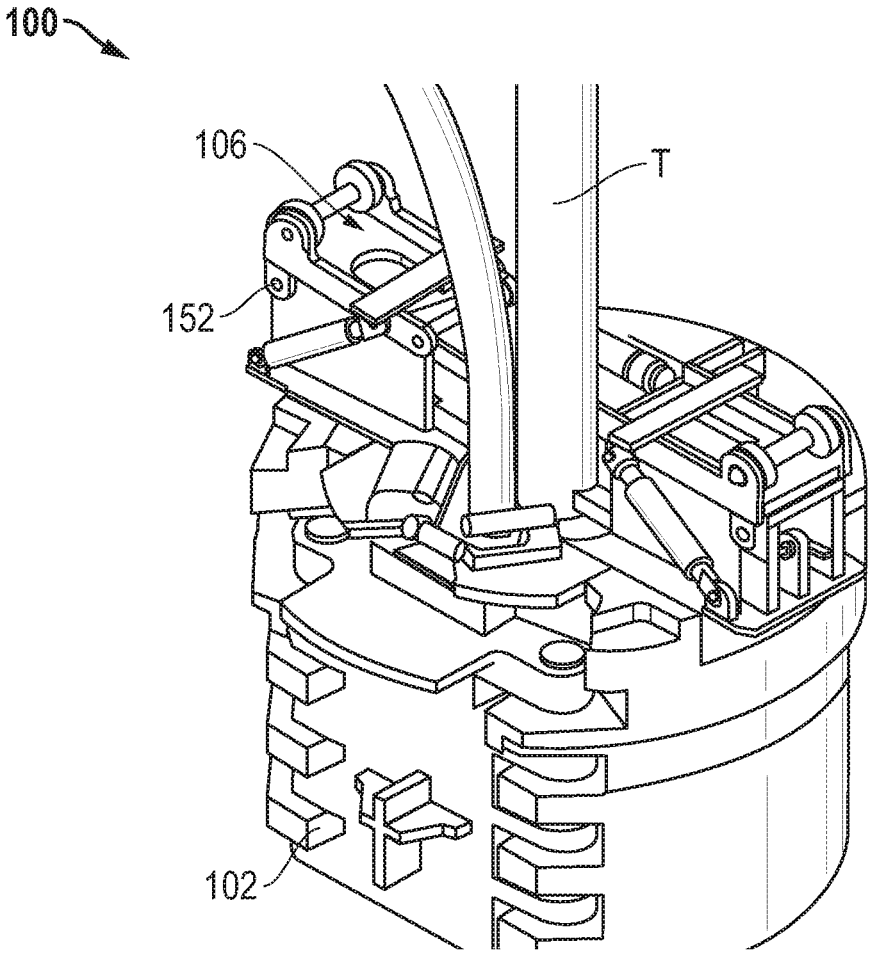

Referring to FIG. 9, once the first guide 104 is reconfigured to the second configuration, the tubular T and umbilical line UL can then be lowered through the slip 102 while the second guide 106 guides the tubular T. After the engagement element 130 passes through the first guide 104, the first guide 104 can be reconfigured to the first configuration and the second guide 106 can be reconfigured to the second configuration, as illustrated in FIG. 10. In a particular embodiment, the first guide 104 can be reconfigured to the first configuration prior to reconfiguring the second guide 106 to the second configuration. In such a manner, the tubular T remains supported during the entire drilling operation. As illustrated in FIG. 10, the safety device 152 can be reengaged after the second guide 106 is reconfigured from the first configuration to the second configuration.

The tubular T can be lowered further into the wellbore through the slip 102 until the tubular T requires the placement of additional tubular $T_3$ (FIG. 2). The process can then be repeated a number of times until the required depth is reached.

In an embodiment, the first and second guides 104 and 106 are adapted to be aligned with a current in water below the system 100. More particularly, and as previously described in accordance with a particular embodiment, the first and second supports 108, 110, 118, and 120 of the first and second guides 104 and 106 can lie along a single vertical plane. In certain instances, the plane along which the first and second guides 104 and 106 are disposed can be aligned, or generally aligned, with the direction of the current, thus allowing the supports to most effectively bias the tubular T and maintain the tubular T in proper alignment with the wellbore.

EMBODIMENTS

Embodiment 1

A method of conducting subterranean drilling operations comprising:

guiding a tubular with a first guide arranged in a first configuration;

coupling an umbilical line to the tubular with an engagement element;

guiding the tubular with a second guide;

arranging the first guide to a second configuration to permit longitudinal passage of the engagement element past the first guide; and arranging the first guide to the first configuration after the engagement element is past the first guide.

Embodiment 2

The method of embodiment 1, wherein the first guide comprises a plurality of supports including a first support and a second support.

Embodiment 3

The method of embodiment 2, wherein the first support and second support are adapted to be disposed on opposite sides of the tubular.

Embodiment 4

The method of any one of embodiments 2 and 3, wherein arranging the first guide from the first configuration to the second configuration comprises translating at least one of the first and second supports, rotating at least one of the first and second supports, or a combination thereof.

Embodiment 5

The method of any one of embodiments 2-4, wherein the first guide defines a tubular receiving area having a first diameter, $D_1$, in the first configuration and a second diameter, $D_2$, in the second configuration, and wherein $D_2$ is at least 1.01 $D_1$, at least 1.05 $D_1$, at least 1.1 $D_1$, at least 1.25 $D_1$, at least 1.5 $D_1$, or at least 1.75 $D_1$.

Embodiment 6

The method of embodiment 5, wherein $D_2$ is no greater than 10.0 $D_1$, no greater than 5.0 $D_1$, or no greater than 2.0 $D_1$.

Embodiment 7

The method of any one of the preceding embodiments, wherein the first guide is disposed at a first vertical elevation and the second guide is disposed at a second vertical elevation different than the first vertical elevation.

Embodiment 8

The method of embodiment 7, wherein the first vertical elevation is below the second vertical elevation.

Embodiment 9

The method of any one of embodiments 7 and 8, wherein the first and second guides are vertically spaced apart by at least a thickness, $T_{EE}$, of the engagement element, as measured parallel with a length of the tubular.

Embodiment 10

The method of embodiment 9, wherein the first and second guides are spaced apart by at least $T_{EE}$+0.1 $T_{EE}$, at least $T_{EE}$+0.5 $T_{EE}$, or at least $T_{EE}$+1.0 $T_{EE}$.

Embodiment 11

The method of any one of embodiments 9 and 10, wherein the first and second guides are spaced apart by no greater than $T_{EE}$+20.0 $T_{EE}$, no greater than $T_{EE}$+10.0 $T_{EE}$, or no greater than $T_{EE}$+5.0 $T_{EE}$.

Embodiment 12

The method of any one of the preceding embodiments, further comprising arranging the second guide from a second configuration, where the second guide is spaced apart from the tubular, to a first configuration, where the second guide is adapted to guide the tubular.

Embodiment 13

The method of embodiment 12, wherein arranging the second guide from the second configuration to the first configuration comprises translation of a support of the second guide, rotation of a support of the second guide, or a combination thereof.

Embodiment 14

The method of any one of embodiments 12 and 13, wherein arranging the second guide comprises a rotational movement, and wherein arranging the first guide comprises a translational movement.

Embodiment 15

The method of any one of the preceding embodiments, wherein the engagement element comprises a clamp having a Shore A durometer hardness no greater than 90.

Embodiment 16

The method of any one of the preceding embodiments, wherein coupling the umbilical line to the tubular with the engagement element comprises installing the engagement element relative to the tubular and securing the engagement element with the tubular using a wrap.

Embodiment 17

The method of any one of the preceding embodiments, further comprising disengaging a safety device adapted to prevent accidental movement of the second guide between the first and second configurations prior to guiding the tubular with the second guide.

Embodiment 18

The method of embodiment 17, wherein the safety device comprises a locking pin.

Embodiment 19

The method of any one of the preceding embodiments, wherein moving the first guide to the second configuration occurs after engaging the second guide to guide the tubular.

Embodiment 20

The method of any one of the preceding embodiments, wherein the first guide comprises a first support and a second support, wherein the second guide comprises a first support and a second support, and wherein the first support of the first guide and the first support of the second guide are disposed along a same vertical plane.

Embodiment 21

The method of any one of the preceding embodiments, further comprising aligning at least one of the first and second guides with respect to a water current below a drill rig including the at least one of the first and second guides.

Embodiment 22

The method of any one of the preceding embodiments, wherein the method is used for offshore drilling operations.

Embodiment 23

The method of any one of the preceding embodiments, further comprising:

advancing the tubular into a wellbore when the tubular is guided by at least one of the first and second guides; and pausing advancement of the tubular into the wellbore during periods of time when arranging the first or second guides between the first and second configurations.

Embodiment 24

The method of embodiment 23, wherein advancing and pausing advancement of the tubular is performed manually, at least partially autonomously, or fully autonomously.

Embodiment 25

The method of any one of embodiments 23 and 24, wherein pausing advancement of the tubular into the wellbore is performed such that pausing corresponds with the engagement element being disposed entirely between the first and second guides.

Embodiment 26

A system for conducting subterranean drilling operations comprising:

a first guide adapted to guide a tubular; and a second guide adapted to guide the tubular, wherein the first and second guides are disposed at different vertical elevations, and wherein the first and second guides are both selectively arrangeable to guide the tubular.

Embodiment 27

A system for conducting subterranean drilling operations comprising:

a first guide adapted to guide a tubular, the first guide being translatable between a first configuration to guide the tubular and a second configuration spaced apart from the tubular; and a second guide adapted to guide the tubular, the second guide being rotatable between a first configuration to guide the tubular and a second configuration spaced apart from the tubular.

Embodiment 28

A system for conducting subterranean operations comprising a first guide and a second guide disposed at different vertical elevations, wherein the first and second guides are adapted to provide continuous support to a tubular in a lateral direction when the tubular is coupled with an umbilical line.

Embodiment 29

The system of any one of embodiments 26-28, wherein:

the first guide comprises a first support and a second support; and the second guide comprises a first support and a second support.

Embodiment 30

The system of embodiment 29, wherein the first supports of the first and second guides are disposed along a first vertical plane, and wherein the second supports of the first and second guides are disposed along a second vertical plane.

Embodiment 31

The system of embodiment 30, wherein the first and second planes lie along a same plane.

Embodiment 32

The system of any one of embodiments 26-31, wherein the first guide comprises a support adapted to translate and the second guide comprises a support adapted to rotate.

Embodiment 33

The system of any one of embodiments 26-32, wherein the second guide is adapted to rotate at least 5°, at least 10°, at least 15°, at least 20°, at least 30°, at least 45°, at least 60°, or at least 75°.

Embodiment 34

The system of any one of embodiments 26-33, wherein the second guide is adapted to rotate no greater than 180°, or no greater than 90°.

Embodiment 35

The system of any one of embodiments 26-34, wherein at least one of the first and second guides is coupled with an actuator adapted to bias the at least one of the first and second guides between the first and second configurations.

Embodiment 36

The system of any one of embodiments 26-35, wherein the second guide comprises a locking pin adapted to selectively prevent reconfiguration of the second guide between the first and second configurations.

Embodiment 37

The system of any one of embodiments 26-36, wherein the second guide comprises an interface adapted to guide the tubular, and wherein the interface comprises a rotatable member, an arcuate member, or a combination thereof.

Embodiment 38

The system of any one of embodiments 26-37, wherein the first guide comprises an interface adapted to guide the tubular, and wherein the interface comprises a rotatable member, an arcuate surface, or a combination thereof.

Embodiment 39

The system of any one of embodiments 26-38, wherein the first guide is translatable along a plane, and wherein the second guide is rotatable along the same plane.

Note that not all of the activities described above in the general description or the examples are required, that a portion of a specific activity may not be required, and that one or more further activities may be performed in addition to those described. Still further, the order in which activities are listed is not necessarily the order in which they are performed.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Separate embodiments may also be provided in combination in a single embodiment, and conversely, various features that are, for brevity, described in the context of a single embodiment, may also be provided separately or in any subcombination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

The invention claimed is:

1. A method of conducting subterranean drilling operations comprising:

guiding a tubular with a first guide arranged in a first configuration, wherein the first guide comprises a plurality of supports including a first support and a second support, and wherein the first support and the second support are disposed on opposite sides of the tubular;

coupling an umbilical line to the tubular with an engagement element;

guiding the tubular with a second guide, wherein the second guide comprises a plurality of supports including a third support and a fourth support, and wherein the third support and the fourth support are disposed on opposite sides of the tubular;

arranging the first guide to a second configuration to permit longitudinal passage of the engagement element past the first guide; and arranging the first guide to the first configuration after the engagement element is past the first guide.

2. The method of claim 1, wherein the third support is configured to rotate about a first axis that is perpendicular to a longitudinal axis of the tubular, and wherein the fourth support is configured to rotate about a second axis that is perpendicular to the longitudinal axis of the tubular and parallel to the first axis, and wherein the first axis is spaced apart from the second axis.

3. The method of claim 1, wherein arranging the first guide from the first configuration to the second configuration comprises translating at least one of the first support and the second support, rotating at least one of the first support and the second support, or a combination thereof.

4. The method of claim 1, wherein the first guide defines a tubular receiving area having a first diameter, D1, in the first configuration and a second diameter, D2, in the second configuration, wherein D2 is at least 1.01 D1, at least 1.05 D1, at least 1.1 D1, at least 1.25 D1, at least 1.5 D1, or at least 1.75 D1, and wherein D2 is no greater than 10.0 D1, no greater than 5.0 D1, or no greater than 2.0 D1.

5. The method of claim 1, wherein the first guide is disposed at a first vertical elevation and the second guide is disposed at a second vertical elevation different than the first vertical elevation.

6. The method of claim 5, wherein the first vertical elevation is below the second vertical elevation.

7. The method of claim 5, wherein the first guide and the second guide are vertically spaced apart by at least a thickness, TEE, of the engagement element, as measured parallel with a length of the tubular.

8. The method of claim 7, wherein the first guide and the second guide are spaced apart by at least TEE+0.1 TEE, at least TEE+0.5 TEE, or at least TEE+1.0 TEE, and wherein the first guide and the second guide are spaced apart by no greater than TEE+20.0 TEE, no greater than TEE+10.0 TEE, or no greater than TEE+5.0 TEE.

9. The method of claim 1, further comprising arranging the second guide from a second configuration, where the second guide is spaced apart from the tubular, to a first configuration, where the second guide is adapted to guide the tubular.

10. The method of claim 1, wherein coupling the umbilical line to the tubular with the engagement element comprises installing the engagement element relative to the tubular and securing the engagement element with the tubular using a wrap.

11. The method of claim 10, further comprising disengaging a safety device adapted to prevent accidental movement of the second guide between the first configuration and the second configuration prior to guiding the tubular with the second guide.

12. A system for conducting subterranean drilling operations comprising:

a first guide adapted to guide a tubular; and a second guide adapted to guide the tubular, wherein the first guide and the second guide are disposed at different vertical elevations, wherein the first guide and the second guide are both selectively reconfigurable to guide the tubular, and wherein at least one of the first guide and the second guide is coupled with an actuator adapted to bias the at least one of the first guide and the second guide between a first configuration and a second configuration.

13. The system of claim 12, wherein the first guide is translatable between a first configuration to guide the tubular and a second configuration spaced apart from the tubular; and wherein the second guide is rotatable between a first configuration to guide the tubular and a second configuration spaced apart from the tubular.

14. The system of claim 12, wherein the first guide and the second guide are adapted to provide continuous support to the tubular in a lateral direction when the tubular is coupled with an umbilical line.

15. The system of claim 12, wherein the first guide comprises a support adapted to translate and the second guide comprises a support adapted to rotate.

16. The system of claim 15, wherein the second guide is adapted to rotate at least 5°, at least 10°, at least 15°, at least 20°, at least 30°, at least 45°, at least 60°, or at least 75°, and wherein the second guide is adapted to rotate no greater than 180°, or no greater than 90°.

17. The system of claim 12, wherein the first guide comprises a first support and a second support and the second guide comprises a third support and a fourth support, with the first support and the third support are disposed on one side of the tubular and the second support and the fourth support are disposed on an opposite side of the tubular from the first support and the third support.

18. The system of claim 12, wherein the second guide comprises a locking pin adapted to selectively prevent reconfiguration of the second guide between a first configuration and a second configuration.

19. The system of claim 12, wherein the second guide comprises an interface adapted to guide the tubular, and wherein the interface comprises a rotatable member, an arcuate member, or a combination thereof, and wherein the first guide comprises an interface adapted to guide the tubular, and wherein the interface comprises a rotatable member, an arcuate surface, or a combination thereof.

20. A system for conducting subterranean drilling operations comprising:

a first guide adapted to guide a tubular; and a second guide adapted to guide the tubular, wherein the first guide and the second guide are disposed at different vertical elevations, and wherein the first guide and the second guide are both selectively reconfigurable to guide the tubular, wherein:

the first guide comprises a first support and a second support; and the second guide comprises a first support and a second support, wherein the first support of the first guide and first support of the second guide are disposed along a first vertical plane, and wherein the second support of the first guide and the second support of the second guide are disposed along a second vertical plane.

* * * * *